US009187956B2

(12) United States Patent
Hutton et al.

(10) Patent No.: US 9,187,956 B2
(45) Date of Patent: Nov. 17, 2015

(54) POINT THE BIT ROTARY STEERABLE SYSTEM

(71) Applicants: Richard Hutton, Bristol (GB); Jeff Rutland, London (GB)

(72) Inventors: Richard Hutton, Bristol (GB); Jeff Rutland, London (GB)

( * ) Notice: Subject to any disclaimer, the term of this patent is extended or adjusted under 35 U.S.C. 154(b) by 526 days.

(21) Appl. No.: 13/628,332

(22) Filed: Sep. 27, 2012

(65) Prior Publication Data

US 2013/0075164 A1 Mar. 28, 2013

Related U.S. Application Data

(60) Provisional application No. 61/539,554, filed on Sep. 27, 2011.

(51) Int. Cl.
*E21B 7/06* (2006.01)

(52) U.S. Cl.
CPC .. *E21B 7/06* (2013.01); *E21B 7/067* (2013.01)

(58) Field of Classification Search
CPC ..... E21B 7/06; E21B 7/08
See application file for complete search history.

(56) References Cited

U.S. PATENT DOCUMENTS

| | | | | |
|---|---|---|---|---|
| 3,743,034 | A | 7/1973 | Bradley | |
| 5,553,678 | A | 9/1996 | Barr et al. | |
| 6,837,315 | B2 | 1/2005 | Pisoni et al. | |
| 2002/0179336 | A1 | 12/2002 | Schaaf et al. | |
| 2003/0127252 | A1 | 7/2003 | Downton et al. | |
| 2004/0262043 | A1 * | 12/2004 | Schuaf | 175/57 |
| 2006/0090935 | A1 * | 5/2006 | Van Steenwyk et al. | 175/73 |
| 2008/0000693 | A1 * | 1/2008 | Hutton | 175/61 |
| 2010/0025116 | A1 * | 2/2010 | Hutton | 175/61 |

FOREIGN PATENT DOCUMENTS

| | | | |
|---|---|---|---|
| EP | 1258593 | A2 | 11/2002 |
| GB | 2257182 | A | 1/1993 |
| GB | 2413346 | B | 6/2006 |
| WO | 9630616 | A1 | 10/1996 |
| WO | 2007134748 | A1 | 11/2007 |

OTHER PUBLICATIONS

The International Search Report and Written Opinion From Corresponding International Application PCT/IB2012/002313, mailed Mar. 21, 2014 (14 pages).

* cited by examiner

*Primary Examiner* — William P Neuder
(74) *Attorney, Agent, or Firm* — King & Spalding LLP

(57) ABSTRACT

A method, device, and system is described herein for pointing a rotary drill bit. A rotary bit pointing device is positioned between a proximal end of a control shaft and a universal joint. As the bottom hole assembly rotates, various portions of the rotary bit pointing device are enabled and subsequently disabled to apply a substantially constant force in a substantially constant direction to the control shaft. Such a force causes the distal end of the control shaft to point the rotary drill bit in a target direction.

11 Claims, 7 Drawing Sheets

POINT THE BIT ROTARY STEERABLE SYSTEM

CROSS-REFERENCE TO RELATED APPLICATIONS

This application claims priority under 35 U.S.C. §119 to U.S. Provisional Patent Application Ser. No. 61/539,554, titled "Point the Bit Rotary Steerable System" and filed on Sep. 27, 2011, the entire contents of which are hereby incorporated herein by reference.

TECHNICAL FIELD

The present disclosure relates generally to a rotary steerable tool and more particularly to systems, methods, and devices for pointing a drill bit using a downhole actuation system.

BACKGROUND

Field formations can include reservoirs holding one or more resources. To reach such reservoirs so that the resources can be extracted, one or more holes are drilled through the field formations. Various drilling techniques can be used when creating a wellbore in an exploration process.

One or more such techniques involve the use of rotary steerable tools. Rotary steerable tools are used to direct the path of wellbores when drilling for resources. One application in which rotary steerable tools are used is when an entity is drilling multiple wells in different directions from one location. Another application in which rotary steerable tools are used is when an entity is positioning a wellbore horizontally along the length of a reservoir to maximize the amount of resources collected.

SUMMARY

In general, in one aspect, the disclosure relates to a method for pointing a rotary drill bit. The method can include receiving a target direction in a formation to point the rotary drill bit while drilling a wellbore in a formation. The method can also include enabling, at a first rotational position, a first deflection device of a number of deflection devices, where enabling the first deflection device applies a force to a control shaft in an applied direction. The method can further include disabling, after the first rotational position, the first deflection device, where disabling the first deflection device removes the force applied to the control shaft. The method can also include enabling, at a second rotational position, a second deflection device of the deflection devices, where enabling the second deflection device applies the force to the control shaft in the applied direction. The method can further include disabling, after the second rotational position, the second deflection device, where disabling the second deflection device removes the force applied to the control shaft. The first rotational position and the second rotational position can be adjacent to each other. The force can be applied to the control shaft between a proximal end of the control shaft and a pivot point of the control shaft. The proximal end of the control shaft can be opposite a distal end of the control shaft, where the distal end of the control shaft is coupled to the rotary drill bit.

In another aspect, the disclosure relates to a rotary bit pointing device. The rotary bit pointing device can include a shaft that includes a proximal end and a distal end, and an end plate disposed over an outer surface of the shaft toward the proximal end of the shaft, where the end plate can include a top surface having a first inner perimeter, where the top surface can include a number of passthrough apertures and a number of first securing apertures. The rotary bit pointing device can also include a retaining plate disposed over the outer surface of the shaft toward the distal end of the shaft, where the retaining plate can include a bottom surface having a second inner perimeter, where the bottom surface can include a number of second securing apertures. The rotary bit pointing device can further include a number of deflection devices disposed around the outer surface of the shaft between the end plate and the retaining plate, where each of the deflection devices can include a protrusion that traverses one of the passthrough apertures. The rotary bit pointing device can also include a number of retaining pins disposed around the outer surface of the shaft between the deflection devices, the end plate, and the retaining plate, where the retaining pins are mechanically coupled to the end plate using the first securing apertures and the retaining plate using the second securing apertures. The rotary bit pointing device can further include a control device mechanically coupled to the protrusion of each of the plurality of deflection devices, where the deflection devices and the retaining plate can be slidably coupled to a proximal end of a control shaft, where the control shaft can include a middle portion mechanically coupled to a universal joint and a distal end mechanically coupled to a rotary drill bit.

In yet another aspect, the disclosure relates to a point the bit rotary steerable system. The point the bit rotary steerable system can include a rotary drill bit, and a bit shaft having a distal end mechanically coupled to the rotary drill bit. The point the bit rotary steerable system can also include a universal joint mechanically coupled to a proximal end of the bit shaft, and a body having a distal end mechanically coupled to the universal joint. The point the bit rotary steerable system can further include a shaft that traverses a cavity in the rotary drill bit, the bit shaft, the universal joint, and the body, where the shaft is pivotally coupled to the universal joint between a proximal end and a distal end of the shaft. The point the bit rotary steerable system can also include a rotary bit pointing device that is coupled to a proximal end of the shaft and is mechanically coupled to a proximal end of the body. The rotary bit pointing device can include a number of deflection devices disposed proximately to a perimeter of the shaft, where each of the deflection devices can include a protrusion. The rotary bit pointing device can also include a control device mechanically coupled to the protrusion of each of the deflection devices. The control device can enable at least one of the deflection devices and can disable a remainder of the deflection devices so that the rotary drill bit is pointed at a particular target in a radial direction.

These and other aspects, objects, features, and embodiments will be apparent from the following description and the appended claims.

BRIEF DESCRIPTION OF THE DRAWINGS

The drawings illustrate only exemplary embodiments and are therefore not to be considered limiting of its scope, as the exemplary embodiments may admit to other equally effective embodiments. The elements and features shown in the drawings are not necessarily to scale, emphasis instead being placed upon clearly illustrating the principles of the exemplary embodiments. Additionally, certain dimensions or positionings may be exaggerated to help visually convey such principles. In the drawings, reference numerals designate like or corresponding, but not necessarily identical, elements.

DETAILED DESCRIPTION OF EXEMPLARY EMBODIMENTS

Figure 1:
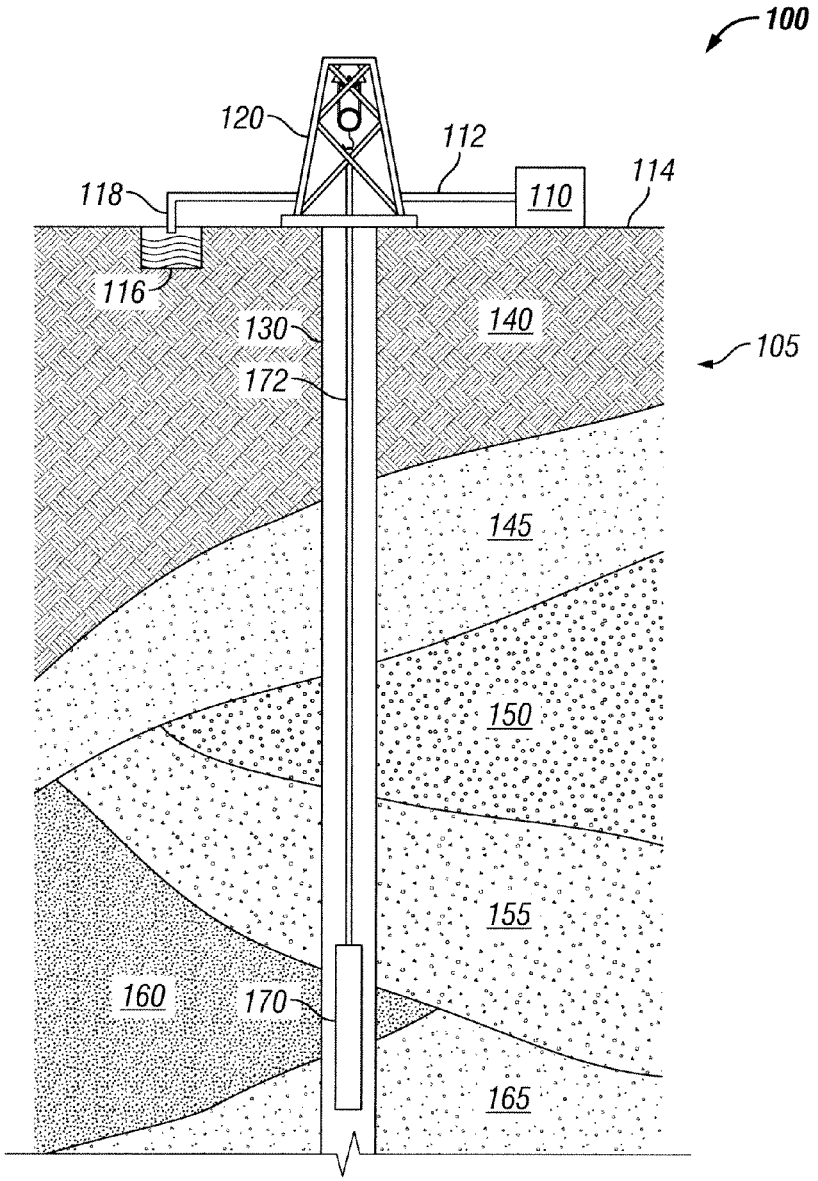
FIG. 1 shows a schematic view, partially in cross section, of a field undergoing exploration using an exemplary point the bit rotary steerable system in accordance with one or more exemplary embodiments.

Exemplary embodiments will now be described in detail with reference to the accompanying figures. Like, but not necessarily identical, elements in the various figures are denoted by like reference numerals for consistency. In the following detailed description of the exemplary embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, the exemplary embodiments described herein provide systems, methods, and devices for pointing a rotary drill bit. More specifically, the exemplary embodiments provide for controlling a direction in which a drill bit points during an operation (e.g., exploration, production) in a field. For clarification, a field can include part of a subterranean formation. More specifically, a field as referred to herein can include any underground geological formation containing a resource that may be extracted. Part, or all, of a field may be on land, water, and/or sea. Also, while a single field measured at a single location is described below, any combination of one or more fields, one or more processing facilities, and one or more wellsites can be utilized. The resource can include, but is not limited to, hydrocarbons (oil and/or gas), water, steam, helium, and minerals. A field can include one or more reservoirs, which can each contain one or more resources.

When a drill bit is pointed to steer the bottom hole assembly, the drill bit is directed to a target location (also called a target direction) in the wellbore. Because the bottom hole assembly (as well as the entire drill string) is rotating, pointing the drill bit at the target location can be challenging. In other words, the point to which the drill bit is directed is stationary within the wellbore, but the drill bit itself is rotating during the field operation. Because exemplary embodiments have a target location that is at an acute angle relative to the axial direction of the non-pivoting portion of the bottom hole assembly (in other words, in a radial direction), constant adjustment are made to keep the drill bit pointed at the target location during the field operation.

When the bottom hole assembly rotates relative to the target location, there can be a number of rotational positions of the bottom hole assembly relative to the target location. The rotational positions can be discrete or continuous. The sum of the rotational positions cover a full rotation (360°) of the bottom hole assembly.

In one or more exemplary embodiments, a user is any entity that uses the systems and/or methods described herein. For example, a user may be, but is not limited to, a drilling engineer, a company representative, control system, a contractor, an engineer, or a supervisor.

FIG. 1 is a schematic view, partially in cross section, of a field 100 undergoing exploration using an exemplary point the bit rotary steerable system in accordance with one or more exemplary embodiments. Each of these components is described below. Embodiments of the field 100 are not limited to the configuration shown in FIG. 1 and discussed herein.

The bottom hole assembly 170 can be suspended by a rig 120 using drill pipe 172 and advanced into the subterranean formation 105 to form a wellbore 130. The subterranean formation 105 has a number of geological structures. For example, as shown in FIG. 1, the subterranean formation 105 can have a clay layer 140, a sandstone layer 145, a limestone layer 150, a shale layer 155, a sand layer 160, and a reservoir 165.

Data acquisition tools and/or sensing devices can be used to measure the subterranean formation 105 and detect the characteristics of the various layers of the subterranean formation 105. The data collected by data acquisition tools, as well as other data measured by one or more sensing devices located at various locations (e.g., the mud pit 116, at the surface 114, on the rig 120) in the field 100, can be gathered and processed by a data acquisition system 110 that is communicably coupled to the various data acquisition tools and/or sensing devices. In certain exemplary embodiments, the data acquisition system 110 can perform other functions with respect to the field data, including but not limited to generating models, and communicating with (generating signals, sending signals, receiving signals) one or more devices in the field, including but not limited to the control device (described below with respect to FIGS. 3A-C).

A mud pit 116 is used to draw drilling mud (also called drilling fluid) into the bottom hole assembly 170 via a flow line 118 for circulating drilling mud through the bottom hole assembly 170, up the wellbore 130 and back to the surface 114. The drilling mud is usually filtered and returned to the mud pit 116. A circulating system can be used for storing, controlling, or filtering the flowing drilling muds. The bottom hole assembly 170 is advanced into the subterranean formation to reach a reservoir 165. Each well can target one or more reservoirs 165. The bottom hole assembly 170 can be adapted for measuring downhole properties using logging while drilling (LWD) tools, measurement while drilling (MWD) tools, or any other suitable measuring tool (also called data acquisition tools).

The data acquisition tools can be integrated with the bottom hole assembly 170 and generate data plots and/or measurements. These data plots and/or measurements are depicted along the field 100 to demonstrate the data generated by the various operations. While only a simplified field 100 configuration is shown, it will be appreciated that the field 100 can cover a portion of land, sea, and/or water locations that hosts one or more wellsites. Production can also include one or more other types of wells (e.g., injection wells) for added recovery. One or more gathering facilities can be operatively connected to one or more of the wellsites for selectively collecting downhole fluids and/or resources from the wellsite (s).

Further, while FIG. 1 describes data acquisition tools and/or sensing devices used to measure properties of a field, it will be appreciated that the tools and/or devices can be used in connection with non-wellsite operations, such as mines, aquifers, storage, or other subterranean facilities. Also, while certain data acquisition tools (e.g., drilling tool 102, data acquisition system 110) are depicted, it will be appreciated that various other measurement tools (e.g., sensing parameters, seismic devices) measuring various parameters of the subterranean formation and/or its geological formations can be used. Various sensors can be located at various positions along the wellbore and/or as part of the monitoring tools to collect and/or monitor the desired data. Other sources of data can also be provided from offsite locations.

When a data acquisition tool and/or other device (e.g., the control device described below with respect to, for example, FIGS. 3C, 5A, 5B, and 6) is incorporated with the bottom hole assembly 170, such tool and/or devices can communicate with the data acquisition system 110 in one or more of a number of ways. The data acquisition system 110 can communicate with a data acquisition tool and/or a measuring device using wired and/or wireless technology. As an example of using a wireless technology, the data acquisition system 110 can communicate with a downhole tool and/or device using energy waves that are transported through the drilling fluid during a field operation.

Figure 2:
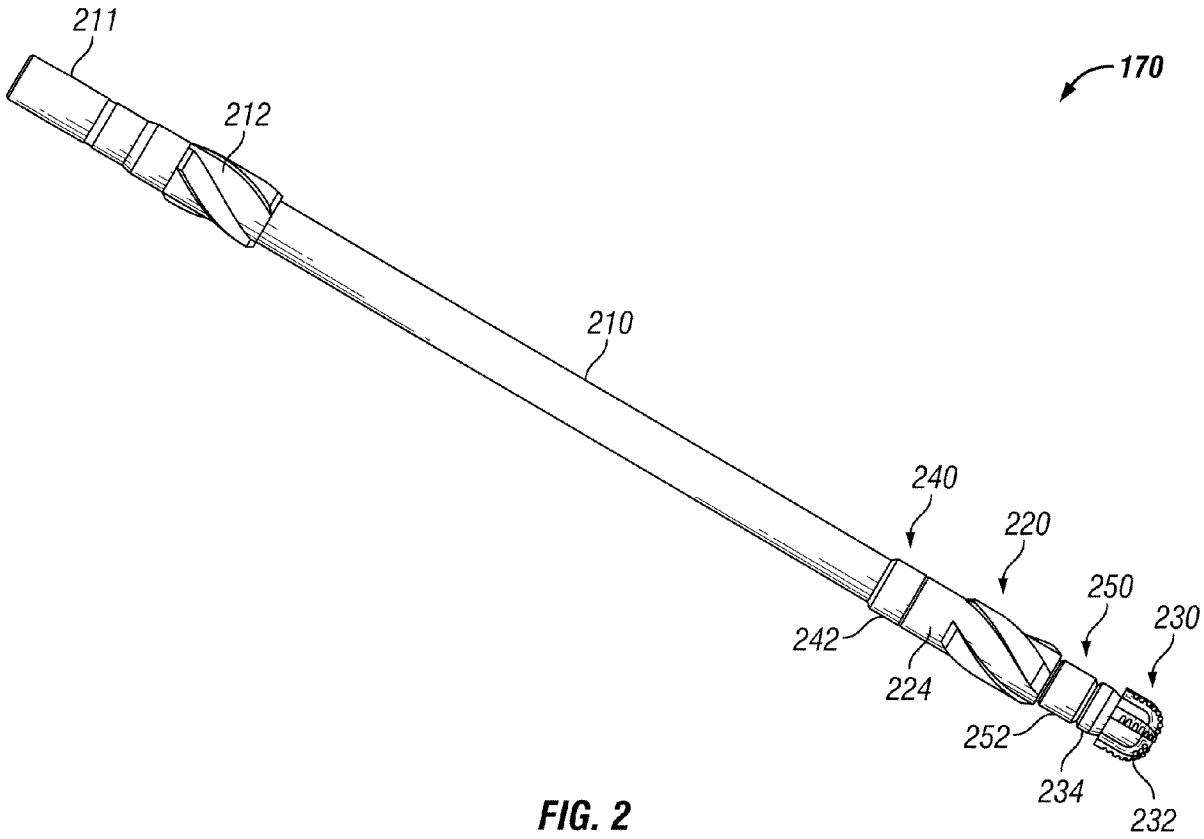
FIG. 2 shows a side view of a bottom hole assembly that includes an exemplary point the bit rotary steerable system in accordance with one or more exemplary embodiments.

FIG. 2 shows a side view of a bottom hole assembly 170 that includes an exemplary point the bit rotary steerable system 220 in accordance with one or more exemplary embodiments. Referring now to FIGS. 1 and 2, the bottom hole assembly 170 of FIG. 2 includes a drill collar 210 positioned between an upper sleeve stabilizer 212 and the point the bit rotary steerable system 220. The bottom hole assembly 170 also includes a drill bit assembly 230 located at the end of the bottom hole assembly 170, below the point the bit rotary steerable system 220. Another drill collar 211 can also be located on the opposite side of (further uphole from) the upper stabilizer 212.

The drill collars 210, 211 can be pipes of a known inner diameter and outer diameter along a known length and have substantially uniform thickness along the length. The drill collars 210, 211 can be made of one or more of a number of suitable materials for the environment in which the field operation is being performed. Examples of such materials can include, but are not limited to, stainless steel and galvanized steel.

The upper sleeve stabilizer 212 can mechanically stabilize the bottom hole assembly 170 in the borehole in order to avoid unintentional sidetracking and/or vibrations, and/or to ensure the quality of the hole being drilled. In certain exemplary embodiments, the upper sleeve stabilizer 212 can include a hollow cylindrical body and stabilizing blades, both made of high-strength steel and/or some other suitable material. The blades of the upper sleeve stabilizer 212 can have one or more of a number of shapes, including but not limited to straight and spiraled. The blades can be hardfaced for wear resistance.

The upper sleeve stabilizer 212 can be integral (i.e., formed from a single piece of material such as steel) or a composite of multiple pieces mechanically coupled together. An example of the latter case can be an upper sleeve stabilizer 212 where the blades are located on a sleeve, which is then screwed on the body of the upper sleeve stabilizer 212. Another example of the latter case is an upper sleeve stabilizer 212 where the blades are welded to the body. In certain exemplary embodiments, a near-bit stabilizer 224, as shown in FIG. 2, substantially similar to the upper sleeve stabilizer 212, covers the point the bit rotary steerable system 220 just above the drill bit assembly 230.

The drill collars 210, 211, the stabilizers (e.g., the upper sleeve stabilizer 212, the near-bit stabilizer 224), the drill bit assembly 230, and/or any other components of the bottom hole assembly 170 are mechanically coupled to each other using one or more of a number of coupling methods. For example, as is common in the industry, such components are coupled to each other using mating threads that are disposed on each end of each component. When such components of the bottom hole assembly 170 are mechanically coupled to each other, the coupling is conducted in such a way as to comply with engineering and operational requirements. For example, when mating threads are used, a proper torque is applied to each coupling.

Much of the point the bit rotary steerable system 220 is described below with respect to FIGS. 3A-5B. In FIG. 2, most of the point the bit rotary steerable system 220 is hidden from view by the near-bit stabilizer 224. A portion of the body 240 and the bit shaft 250 of the point the bit rotary steerable system 220 is visible in FIG. 2 and is described in more detail below with respect to FIGS. 3A-3C.

The drill bit assembly 230 includes a drill bit 232, and a drill bit collar 234. In FIG. 2, only the distal end of the bit shaft 250 (part of the point the bit rotary steerable system 220) is shown, while the rest of the bit shaft 250 is hidden from view by the near-bit stabilizer 224. The bit shaft 250 is described in more detail below with respect to FIGS. 3A and 3B. The proximal end of the drill bit collar 234 is mechanically coupled to the distal end of the bit shaft 250, while the distal end of the drill bit collar 234 is mechanically coupled to the drill bit 232. The drill bit 232 and the drill bit collar 234 can be formed as a single piece (as from a mold) or from multiple pieces that are mechanically coupled to each other using one more of a number of coupling methods, including but not limited to welding, mating threads, and compression fittings.

The drill bit 232 is a tool used to crush and/or cut rock. The drill bit 232 is located at the distal end of the bottom hole assembly 170 and can be any type (e.g., a polycrystalline diamond compact bit, a roller cone bit, an insert bit) of drill bit having any dimensions (e.g., 5 inch diameter, 9 inch diameter, 50 inch diameter) and/or other characteristics (e.g., rotating cones, rotating head, rotating cutters). The drill bit 232 can include one or more of a number of materials, including but not limited to steel, diamonds, and tungsten carbide.

Figure 3A:
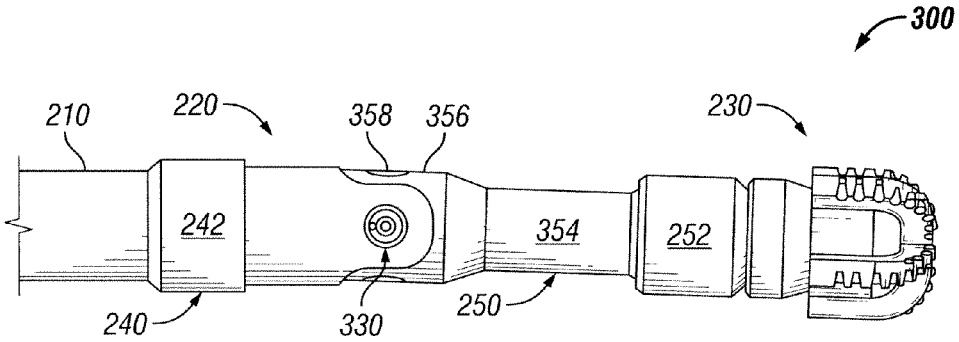
FIGS. 3A-C shows various views of an exemplary point the bit rotary steerable system in accordance with one or more exemplary embodiments.
Figure 3B:
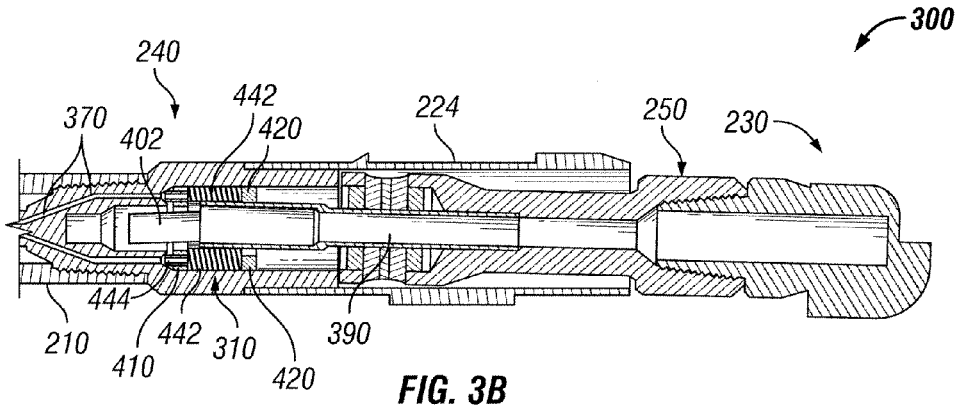
Figure 3C:
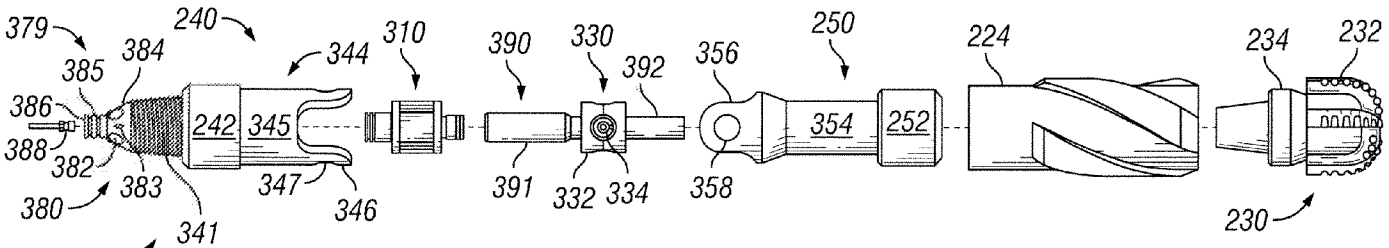

FIGS. 3A-C shows various views of an exemplary point the bit rotary steerable system 300 in accordance with one or more exemplary embodiments. Specifically, FIG. 3A shows a side view of the distal portion 300 of the bottom hole assembly 170, but without the near-bit stabilizer described above with respect to FIG. 2. FIG. 3B shows a cross-sectional side view of the distal portion 300 of the bottom hole assembly 170. FIG. 3C shows an exploded side view of the distal portion 300 of the bottom hole assembly 170. Each of these components is described below. Embodiments of the distal portion 300 of the bottom hole assembly 170 are not limited to the configuration shown in FIGS. 3A-3C and discussed herein. Some of the components of the rotary bit pointing device 310 that are labeled in FIG. 3B are described below with regard to FIGS. 4A and 4B.

Referring to FIGS. 1-3C, the near-bit stabilizer 224, the drill bit assembly 230, and the drill collar 210 are substantially the same as that described above with respect to FIG. 2. The exemplary point the bit rotary steerable system 220 includes the near-bit stabilizer 224, the body 240, the bit shaft 250, a universal joint 330, a rotary bit pointing device 310, a control shaft 390. The body 240 includes a control device 380.

The bit shaft 250, as shown in FIG. 3B, has a cavity that traverses along its length and into which the distal portion of the control shaft 390 is disposed. The bit shaft 250 can have multiple features. For example, the distal end of the bit shaft 250 can include a collar 252 that mechanically couples to the proximal end of the drill bit collar 234. As another example, the proximal end of the bit shaft 250 can include one or more extensions 356. In FIGS. 3A-C, the bit shaft 250 has two extension 356 that are disposed on opposite sides of each other.

Each extension 356 can include at least one coupling feature 358 disposed on the extension 356. In certain exemplary embodiments, the coupling feature 358 disposed on an extension 358 can take one or more of a number of forms, depending on the configuration of the universal joint 330 (described below). For example, as shown in FIGS. 3A-C, the coupling feature 358 is an aperture that traverses the extension 358.

Each extension 356 and corresponding coupling feature 358 at the proximal end of the bit shaft 250 is configured to slide over the distal end 392 of the control shaft 390 and couple to at least a portion of the universal joint 330. The universal joint 330 (also called a U-joint or ujoint) is any feature that allows the control shaft 390 to pivot about an axis. When the control shaft 390 pivots, the distal end 392 of the control shaft 390 travels in one direction while the proximal end 391 of the control shaft 390 travels in the opposite direction. When the control shaft 390 pivots about the universal joint 330, the control shaft 390 foil is an acute angle relative to the radial axis of the drill collar 210. For example, such an acute angle can be 10°. As another example, such an acute angle can be 5°.

Specifically, a joint feature 332 of the universal joint 330 is pivotally coupled to the control shaft 390 between the distal end 392 and the proximal end 391. In particular, the joint feature 332 allows the bit shaft 250 to swivel or pivot where the bit shaft 250 couples to the joint feature 332. Such an acute angle can be fixed or movable. For example, the acute angle can be set by manipulating the proximal end 391 of the control shaft 390 using the rotary bit pointing device 310. In certain exemplary embodiments, the amount of pivotal movement of the bit shaft 250 (and thus the acute angle formed by the bit shaft 250) can be limited by the near-bit stabilizer 224, as shown in FIG. 3B. Specifically, the portion of the near-bit stabilizer 224 that extends distally toward the collar 252 of the bit shaft 250 limits the pivotal movement of the bit shaft 250.

The universal joint 330 can also include one or more coupling features 334 that are complementary to the coupling features 358 disposed on the extensions 356 of the bit shaft 250. For example, the coupling features 334 of the universal joint shown in FIG. 3C are pins that traverse the apertures in the extensions 356 of the bit shaft 250. The coupling features 334 can be any other type of coupling feature (e.g., slot, bolt, mating thread, aperture) that complement the coupling features 358 of the bit shaft 250 and allow the joint feature 332 to pivot the control shaft 390.

In certain exemplary embodiments, the control shaft 390 has one or more of a number of features that allow the joint feature 332 to pivot the control shaft 390. For example, at the location along the control shaft 390 where the control shaft 390 pivotally couples to the universal joint 330, the control shaft 390 can include apertures that traverse some or all of the control shaft and allow the pins (i.e., coupling features 334 and/or coupling feature 358) to be inserted thereto. Optionally, the walls of such an aperture can include threads that mate with threads on the outer surface of the pins.

The distal end 392 and the proximal end 391 of the control shaft 390 can also have different features from each other. For example, the distal end 392 can be a solid piece, where the proximal end 391 can have a cavity that traverses therethrough. As another example, the distal end 392 can have a larger outer perimeter than the outer perimeter of the proximal end 391. These examples are shown, for example, in FIG. 3C. In such a case, the distal end 392 can slide into the cavity of the bit shaft 250 and direct the bit shaft 250 when the control shaft 390 pivots about the universal joint 330. In addition, the proximal end 391 can slide over at least a portion of the rotary bit pointing device 310 so that the rotary bit pointing device 310 can apply a force to the proximal end 391 that forces the control shaft 390 to pivot about the universal joint 330.

The exemplary body 240 includes a distal portion 344 that includes a collar 345, at least one extension 346 protruding away from the collar 345, and at least one coupling feature 347 disposed on each extension 346. In certain exemplary embodiments, the extensions 346 and associated coupling features 347 are substantially similar to the extensions 356 and associated coupling features 358 at the proximal end of the bit shaft 250. In addition, the extensions 346 and associated coupling features 347 are pivotally coupled to the universal joint 330 in a manner substantially similar to the manner in which the 356 and associated coupling features 358 of the bit shaft 250 are pivotally coupled to the universal joint 330.

The middle portion 242 of the body 240, shown in FIG. 2, has a larger outer perimeter compared to the outer perimeter of the remaining portions of the body 240. The proximal end 379 of the body 240 includes a collar 341. At the distal end of the collar 341 is mechanically coupled a control device 380. The collar 341 of the proximal end 379, the middle portion 242, and the distal end 344 of the body 240 can be formed as a single piece (as from a mold) or from multiple pieces that are mechanically coupled to each other using one more of a number of coupling methods, including but not limited to welding, mating threads, and compression fittings. In addition, the collar 341 of the proximal end 379, the middle portion 242, and the distal end 344 of the body 240 can have a cavity traversing therethrough. In such a case, the cavity can be large enough to allow the rotary bit pointing device 310, the control shaft, and/or the universal joint 330 to be slidably disposed therein.

In certain exemplary embodiments, the control device 380 includes a number of components that allow for control of the rotary bit pointing device 310. Such components can include, but are not limited to, valves, pumps, solenoids, relays, sensors, measuring devices, magnets, and compressors. For example, as shown in FIG. 3C, the control device 380 includes a geostationary valve 388, a control valve 386, a number of flow valves 382, 383, and a cover plate 384. Such components can be used to control a medium (e.g., compressed air, electricity, drilling fluid) that is sent to and/or removed from some or all of the rotary bit pointing device 310. The geostationary valve 388 and/or the control valve 386 can be coupled to the cover plate 384 using a coupling feature 385. To facilitate movement of the medium between the flow valves 382, 383 of the control device 380 and the rotary bit pointing device 310, one or more channels 370 can be used.

In certain exemplary embodiments, the control device 380 selectively enables and disables, using a medium, one or more deflection devices (described below) of the rotary bit pointing device 310 to apply one or more forces to the proximal end 391 of the control shaft 390 at particular times. The control device 380 can include one or more components (e.g., hardware processor, communication device) that allows the control device 380 to send and receive signals regarding the field operation and/or pointing the drill bit 232. For example, the control device 380 can communicate with (send signals to and receive signals from) the data acquisition system 110. In such a case, the data acquisition system 110 can direct the control device 380 to point the drill bit 232 by having the control device 380 manipulate the proximal end 391 of the control shaft 390 using the rotary bit pointing device 310. In certain exemplary embodiments, the control device 380 is part of the rotary bit pointing device 310.

In certain exemplary embodiments, the overall length of the point the bit rotary steerable system 300 varies. For example, the length of the point the bit rotary steerable system 300 can be 4 inches, 20 inches, or any other suitable length.

Figure 4B:
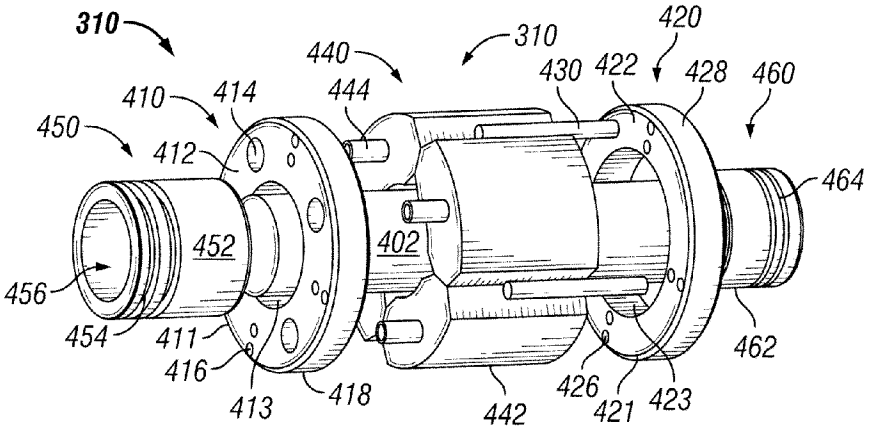
FIGS. 4A and 4B show various views of an exemplary rotary bit pointing device in accordance with one or more exemplary embodiments.
Figure 4A:
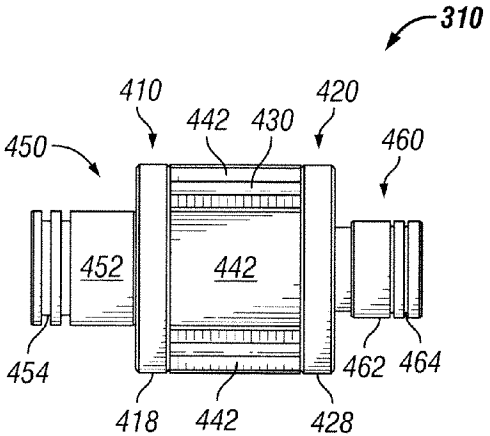

FIGS. 4A and 4B show various views of an exemplary rotary bit pointing device 310 in accordance with one or more exemplary embodiments. The rotary bit pointing device 310 can include a shaft 402, an end plate 410, a retaining plate 420, a number of deflection devices 440, and a number of retaining pins 430. Further, as stated above, the rotary bit pointing device 310 can include the control device 380, which is operatively and mechanically coupled to the rotary bit pointing device 310. Each of these components is described below. Embodiments of the rotary bit pointing device 310 are not limited to the configuration shown in FIGS. 4A and 4B and discussed herein.

The shaft 402 of the rotary bit pointing device 310 can extend along the length of the rotary bit pointing device 310. The shaft 402 can be a solid cylindrical piece or can have a cavity traversing therethrough. The shaft 402 can have a proximal end 450 and a distal end 460. In certain exemplary embodiments, the proximal end 450 can have a larger outer perimeter than the outer perimeter of the distal end 460. The proximal end 450 can include a collar 452 and one or more coupling features 454 disposed beyond the collar 452. The coupling features 454 of the proximal end 450 can be used to mechanically couple the shaft 402 to some complementary coupling features of some other component of the bottom hole assembly 170, including but not limited to the control device 380 and/or the body 240. The proximal end 450 can also have a channel 456 that traverses therethrough.

Likewise, the distal end 460 can include a collar 462 and one or more coupling features 464 disposed beyond the collar 462. The coupling features 464 of the proximal end 460 can be used to mechanically couple the shaft 402 to some complementary coupling features of some other component of the bottom hole assembly 170, including but not limited to an inner surface within the channel of the proximal end 391 of the control shaft 390. The distal end 460 can also have a channel (not shown) that traverses therethrough. The coupling features 464 of the distal end 460 can be the same or different than the coupling features 454 of the proximal end 450. The coupling features 464 and the coupling features 454 can be one or more of a number of types of coupling features, including but not limited to mating threads, slots, clamps, and apertures.

In certain exemplary embodiments, the shaft 402 is made of a flexible material (e.g., rubber) that allows for flex so that the distal end 460 can be fixedly coupled to the proximal end 391 of the control shaft 390 and so that the proximal end 450 can be fixedly coupled to the body 240 while at least one of the deflection devices 440 is enabled (actuated). In other words, the shaft 402 can be flexible so that a force can be applied to the proximal end 391 of the control shaft so that the distal end 392 of the control shaft 390 can point the drill bit 232 of the drill bit assembly 230, as explained below.

The end plate 410 of the rotary bit pointing device 310 can be disposed over the outer surface of the shaft 402 toward the proximal end 450 of the shaft 402. The end plate 410 can include a top surface 412 having an inner perimeter 413 and an outer perimeter 411. In certain exemplary embodiments, the inner perimeter 413 of the end plate 410 is larger than the outer perimeter of the shaft 402. The inner perimeter 413 of the end plate 410 can be less than the outer perimeter of the proximal end 450 of the shaft 402. Disposed along the top surface 412 can be one or more passthrough apertures 414 and/or one or more securing apertures 416.

The end plate 410 can also include a side portion 418 that extends substantially perpendicularly from the outer perimeter 411 of the end plate 410 and extends away from the proximal end 450 of the shaft 402. In certain exemplary embodiments, the end plate 410 forms a solid piece so that the end plate 410 has a thickness the is substantially the same as the length of the side portion 418. The inner surfaces of the passthrough apertures 414 and/or the securing apertures 416 can be smooth, textured, and/or have one or more features (e.g., mating threads).

The retaining plate 420 of the rotary bit pointing device 310 can be disposed over the outer surface of the shaft 402 toward the distal end 460 of the shaft 402. The retaining plate 420 can include a bottom surface 422 having an inner perimeter 423 and an outer perimeter 421. In certain exemplary embodiments, the inner perimeter 423 of the retaining plate 420 is substantially larger than the outer perimeter of the shaft 402. Disposed along the bottom surface 422 can be one or more securing apertures 426. The retaining plate 420 can also include a side portion 428 that extends substantially perpendicularly from the outer perimeter 421 of the retaining plate 420 and extends away from the distal end 460 of the shaft 402. In certain exemplary embodiments, the retaining plate 420 forms a solid piece so that the retaining plate 420 has a thickness the is substantially the same as the length of the side portion 428. The inner surfaces of the securing apertures 426 can be smooth, textured, and/or have one or more features (e.g., mating threads).

The retaining pins 430 can be used to mechanically couple the end plate 410 to the retaining plate 420 and maintain an alignment of the retaining plate 420 relative to the end plate 410. The retaining pins 430 can have a coupling feature (e.g., outer threads, inner threads to a aperture in an end of the retaining pin 430) that can be used to mechanically couple to the securing apertures 416 of the end plate 410 and/or to the securing apertures 426 of the retaining plate 420. The securing apertures 416 of the end plate 410 and the securing apertures 426 of the retaining plate 420 are positioned in such a way that, when the retaining pins 430 are coupled to the end plate 410 and/or the retaining plate 420, the retaining pins 430 do not interfere with the deflection devices 440. One or more additional devices (e.g., a screw, a bolt, a pin, a clamp) can be used to couple the retaining pins 430 to the end plate 410 and/or the retaining plate 420.

In certain exemplary embodiments, the deflection devices 440 are used to apply a directional force in an applied direction to the proximal end 291 of the control shaft 390. The deflection device 440 can be disposed between the retaining pins 430, the end plate 410, and/or the retaining plate 420. There can be one or multiple deflection devices 440 disposed within the rotary bit pointing device 310. The deflection devices 440 can include a body 442 and a protrusion 444. The body 442 physically applies the force to the proximal end 291 of the control shaft 390, while the protrusion 444 is used to communicate the medium used to actuate (enable) and/or deactuate (disable) the body 442 of the deflection device 440.

In certain exemplary embodiments, the protrusion 444 traverses one or more of the passthrough apertures 414 in the end plate 410. In such a case, a portion of the control device 380 mechanically couples to the protrusion 444 so that the control device 380 can feed the medium into the body 442 and/or withdraw the medium from the body 442 through the protrusion 444. The body 442 and/or the protrusion 444 can be made of one or more of a number of materials, including but not limited to rubber, steel, nylon, and plastic.

In certain exemplary embodiments, the location of the deflection devices 440 and the retaining pins 430, in conjunction with the inner perimeter 423 of the retaining plate 420, allow the proximal end 391 of the control shaft 390 to slide over the distal end 460 of the shaft 402 as well as the shaft 402 itself. At the same time, the control shaft 390 can slide underneath the deflection devices 440, the retaining pins 430, and the inner perimeter 423 of the retaining plate 420. In such a case, when a deflection device 440 is enabled (actuated), the deflection device 440 applies a force against the proximal end 391 of the control shaft 390 toward the center of the shaft 402. Alternatively, the channel of the control shaft 390 can sized larger, so that the control shaft 390 can slide over the deflection devices 440 and the retaining pins 430. In such a case, when a deflection device 440 is enabled (actuated), the deflection device 440 applies a force against the proximal end 391 of the control shaft 390 away from the shaft 402.

An example of the body 442 of the deflection device 440 can be, as shown in FIGS. 4A and 4B, a hydraulic bag or bladder. In such a case, the medium can be drilling fluid. To enable a deflection device 440, the control device 380 sends drilling fluid through the protrusion 444 to the deflection device 440 until there is enough drilling fluid in the deflection device 440. Such an amount of drilling fluid can be determined in one or more of a number of ways, including but not limited to measuring a pressure, measuring an amount of time (e.g., an amount of time to fill the deflection device 440 with drilling fluid), and measuring a volume of drilling fluid.

As another example, the body 442 of the deflection device 440 can be a piston. In such a case, the pistons can operate on one or more of a number of mediums, including but not limited to air and drilling fluid. In such a case, multiple (e.g., 3, 4, 5) pistons could be used and disposed in some arrangement (e.g., equidistantly, randomly) around the proximal end 391 of the shaft 390 and/or the inner wall of the body 240. Such pistons could be the same size or different sizes relative to each other. A size of a piston can include, but is not limited to, a diameter (e.g., 1.5 inches, 3 inches), a length, and a range of motion. Such pistons could be made of one or more of a number of suitable materials, including but not limited to steel and tungsten carbide. In certain exemplary embodiments, the body of the piston is made of one material (e.g., steel) and coated with another material (e.g., tungsten carbide).

To enable a deflection device 440, the control device 380 sends enough of the medium through the protrusion 444 to the deflection device 440 and with enough force to move the piston at the distance and in the time required to cause the piston to move the proximal end 391 of the control shaft 390.

During a field operation, the bottom hole assembly 170 is rotating at some speed (e.g., 60 rotations per minute (rpm), 120 rpm, 200 rpm). In order to keep the drill bit 232 pointed in a particular direction, the deflection devices 440 must be enabled (actuated) and disabled (deactuated) to coordinate with the rotational speed of the bottom hole assembly 170. In other words, if the bottom hole assembly 170 is rotating at 60 rpm during a field operation, each deflection device 440 is both enabled and disabled approximately every second.

When the deflection device 440 is disabled, the control device 380 can disable the deflection device 440 actively or passively. When the control device 380 disables the deflection device 440 actively, the control device 380 withdraws the medium from the body 442 of the deflection device 440. For example, a pump used to force the medium into the body 442 when enabling the deflection device 440 can be reversed to force the medium out of the body 442 when disabling the deflection device 440. When the control device 380 disables the deflection device 440 passively, the control device 380 merely releases the pressure used to hold the medium within the body 442 of the deflection device 440. In such a case, the body 442 experiences inward forces, as the bottom hole assembly 170 rotates, that compress the body 442 and force the medium through the protrusion 444. For example, the force applied against the proximal end 391 of the control shaft 390 by an enabled deflection device 440 can cause another deflection device 440, now passively disabled by the control device 380, to become compressed between the proximal end 391 of the control shaft 390 and the inner surface of the body 240. When this occurs, the medium is forced through the protrusion 444 of the disabled deflection device 440.

Unless expressed otherwise, the various components (e.g., end plate 410, shaft 402, retaining plate 420) of the rotary bit pointing device 310 can be made of one or more of an number of suitable materials, including but not limited to stainless steel, galvanized steel, tungsten carbide, nylon, and rubber.

In certain alternative exemplary embodiments, the configuration of the point the bit rotary steerable system 300 varies. For example, as an alternative to the configuration shown in FIGS. 3A-C, the point the bit rotary steerable system 300 can include a number of face seals disposed on the shaft 402 of the rotary bit pointing device 310 as well as on the inner wall of the body 240. In such a case, the shaft 402 of the rotary bit pointing device 310 is rigid rather than flexible. The face seals can be curved along a radius that originates at some common point (e.g., the pivot point of the universal joint 330).

The face seals disposed on the shaft 402 of the rotary bit pointing device 310 can overlap with the face seals disposed on the inner wall of the body 240, regardless of the position of the proximal end 391 of the shaft 390. In addition, a sealing member (e.g., an o-ring, a gasket) can be disposed between the overlapping face seals disposed on the shaft 402 of the rotary bit pointing device 310 and the face seals disposed on the inner wall of the body 240. The purpose of the overlapping face seals can be to prevent drilling fluid from interacting with the internal portions of the universal joint 330 while also allowing the proximal end 391 of the shaft 390 to freely pivot around the universal joint 330 to point the drill bit 232.

In the above example, the face seals disposed on the shaft 402 of the rotary bit pointing device 310 can be positioned distally in front of and/or behind the face seals disposed on the inner wall of the body 240. In addition, or in the alternative, other configurations of the point the bit rotary steerable system 300 can be used to allow the deflection device 440 to apply a force to the proximal end 391 of the shaft 390 to can point the drill bit 232 of the drill bit assembly 230 in a particular direction.

Figure 5A:
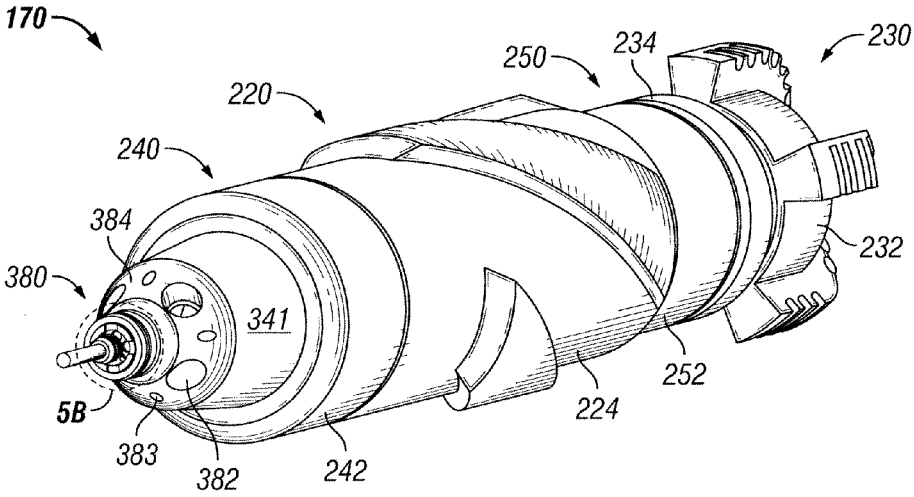
FIGS. 5A and 5B show various views of an exemplary control device in accordance with one or more exemplary embodiments.
Figure 5B:
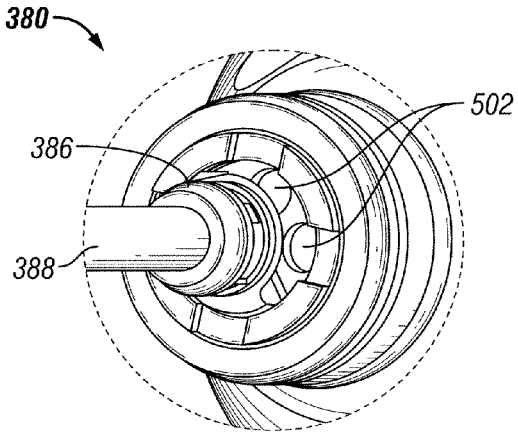

FIGS. 5A and 5B show various views of an exemplary control device 380 in accordance with one or more exemplary embodiments. Specifically, FIG. 5A shows a front perspective view of a bottom hole assembly 170, and FIG. 5B shows a detailed front perspective view of the exemplary control device 380. Each of these components is described below.

Embodiments of the control device 380 are not limited to the configuration shown in FIGS. 5A and 5B and discussed herein.

The control device 380 shown in FIG. 5A is substantially the same as the control device 380 shown in FIG. 3C above. In FIG. 5B, the cover plate 384 and the collar 341 are removed to reveal the flow ports 502. Each flow port 502 can be opened, closed, or partially open. A flow port 502 can be covered by the control valve 386 to close or partially close the flow port 502. The flow ports 502 can be stationary, in which case the control valve 386 can rotate at substantially the same rate of rotation as the bottom hole assembly 170. Alternatively, the control valve 386 can be stationary, in which case, the flow ports 502 can rotate at substantially the same rate of rotation as the bottom hole assembly 170.

Figure 6:
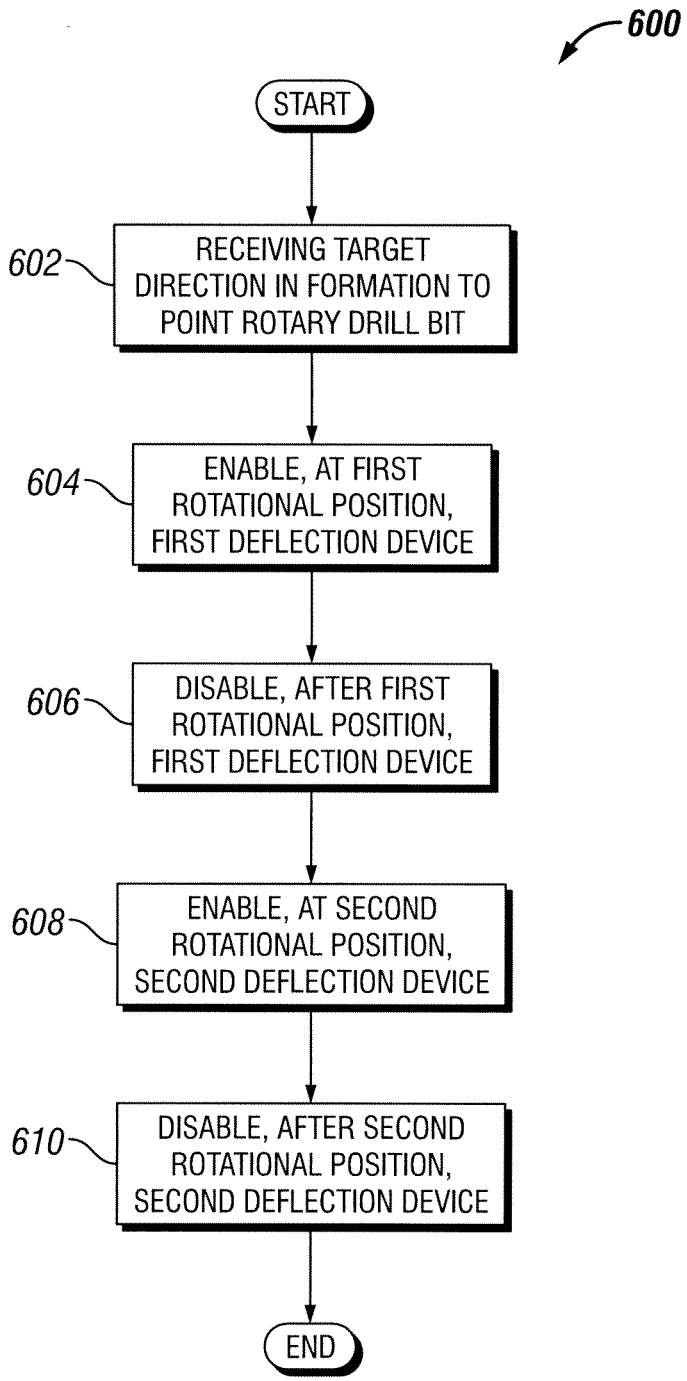
FIG. 6 is a flowchart presenting a method for pointing a rotary drill bit in accordance with one or more exemplary embodiments.

FIG. 6 shows a flowchart of a method 600 for pointing a rotary drill bit in accordance with one or more exemplary embodiments. While the various steps in the flowchart presented herein are described sequentially, one of ordinary skill will appreciate that some or all of the steps may be executed in different orders, may be combined or omitted, and some or all of the steps may be executed in parallel. Further, in one or more of the exemplary embodiments, one or more of the steps described below may be omitted, repeated, and/or performed in a different order. In addition, a person of ordinary skill in the art will appreciate that additional steps may be included in performing the methods described herein. Accordingly, the specific arrangement of steps shown should not be construed as limiting the scope.

Further, in one or more exemplary embodiments, a particular computing device, as described, for example, in FIG. 7 below, is used to perform one or more of the method steps described herein. Also, one or more of the method steps described herein may be performed inside a plug housing of the electrical connector. In one or more exemplary embodiments, at least a portion of the plug housing is detachable from the electrical connector.

Referring now to FIGS. 1-6, the exemplary method 600 begins at the START step and continues to step 602, where a target direction in a formation is received. The target direction is a direction in which a rotary drill bit 232 is pointed within the wellbore 130 while performing a field operation. For example, the field operation can be drilling a wellbore 130 in a subterranean formation 105. In one or more exemplary embodiments, the target direction is a particular radial direction away from the current direction of the wellbore 130. For example, the target direction can be up to a 10° axial deviation, which is the amount of deviation from the directional axis of the body 240. The target direction can be received by the control device 380 located at the bottom hole assembly 170. The target direction can be sent by a data acquisition system 110, which can be located at the surface 114 or at any other location. The target direction can be received by the control device 380 using wired and/or wireless technology. For example, pulses can be sent through the drilling fluid in the wellbore 130, received by the control device 380, and translated into readable instructions relative to pointing the drill bit 232.

In step 604, a first deflection device 440 is enabled at a first rotational position. The first deflection device 440 is among a number of deflection devices 440. The first rotational position coincides with the target direction at that particular point in time during the field operation. The first rotational position can be a point or an area of rotation relative to the target direction. In certain exemplary embodiments, enabling the first deflection device 440 applies a force to the proximal end 391 of the control shaft 390 in an applied direction. The applied direction can be in the same direction or in a substantially opposite direction relative to the target direction. The applied force can cause the control shaft 390 to pivot around the universal joint 330 to form an acute angle with the axial direction of the near-bit stabilizer 224, the body 240, and/or one or more other components of the bottom hole assembly 170.

The first deflection device 440 can be enabled by the control device 380. In certain exemplary embodiments, the control device 380 enables the first deflection device 440 based on instructions received from a data acquisition system 110. The first deflection device 440 can be enabled by injecting an amount of drilling fluid into a bladder (the body 442 of the deflection device 440). In such a case, the drilling fluid can be taken (extracted) from a stream of drilling fluid used to remove cuttings created by the rotary drill bit 232 during the field operation. Alternatively, the first deflection device 440 can be enabled by actuating a piston. For example, the body 442 can be a piston chamber, and pressurizing the piston chamber of the first deflection device 440, using the protrusion 444, enables the first deflection device 440. In such a case, depressurizing the piston chamber disables the first deflection device 440.

In step 606, the first deflection device 440 is disabled after the first rotational position. The first deflection device 440 can be disabled using the control device 380. The control device 380 can disable the first deflection device 440 actively or passively. In certain exemplary embodiments, the control device 380 disables the first deflection device 440 based on instructions received from a data acquisition system 110.

In step 608, a second deflection device 440 is enabled at a second rotational position. The second deflection device 440 can be adjacent to the first deflection device 440, on the opposite side of the shaft 402 from the first deflection device 440, or at some other position relative to the first deflection device 440. Similarly, the second rotational position can be adjacent to the first rotational position, on the opposite side of the shaft 402 from the first rotational position, or at some other position relative to the first rotational position. In certain exemplary embodiments, the 608 can be performed at substantially the same time as step 606.

The second rotational position coincides with the target direction at that particular point in time during the field operation. The second rotational position can be a point or an area of rotation relative to the target direction. In certain exemplary embodiments, enabling the second deflection device 440 applies a force to the proximal end 391 of the control shaft 390 in the applied direction. The applied direction is the same as the applied direction of step 604. The applied force can cause the control shaft 390 to pivot around the universal joint 330 to form substantially the same acute angle with the axial direction of the near-bit stabilizer 224, the body 240, and/or one or more other components of the bottom hole assembly 170, as described above for step 604.

The second deflection device 440 can be enabled by the control device 380. In certain exemplary embodiments, the control device 380 enables the second deflection device 440 based on instructions received from a data acquisition system 110. The second deflection device 440 can be enabled in the same or a different manner than the manner in which the first deflection device 440 is enabled.

In step 610, the second deflection device 440 is disabled after the second rotational position. The second deflection device 440 can be disabled using the control device 380. The control device 380 can disable the second deflection device 440 actively or passively. In certain exemplary embodiments, the control device 380 disables the second deflection device 440 based on instructions received from a data acquisition system 110.

Steps 604-610 can cover one full revolution of the bottom hole assembly 170 if there are only two deflection devices 440. If there are more than two deflection devices 440, then each of the additional deflection devices 440 are similarly enabled and disabled when the respective additional deflection device 440 enters and leaves a rotational position that corresponds to the target position. In certain exemplary embodiments, the bottom hole assembly can rotate up to 200 rpm. If the control device 380 continues to receive instructions from the data acquisition system 110, then steps 604 through 610 of the method 600 are repeated for additional revolutions of the bottom hole assembly 170 until the control device 380 stops receiving such instructions and/or receives different instructions. The exemplary process then proceeds to the END step.

Figure 7:
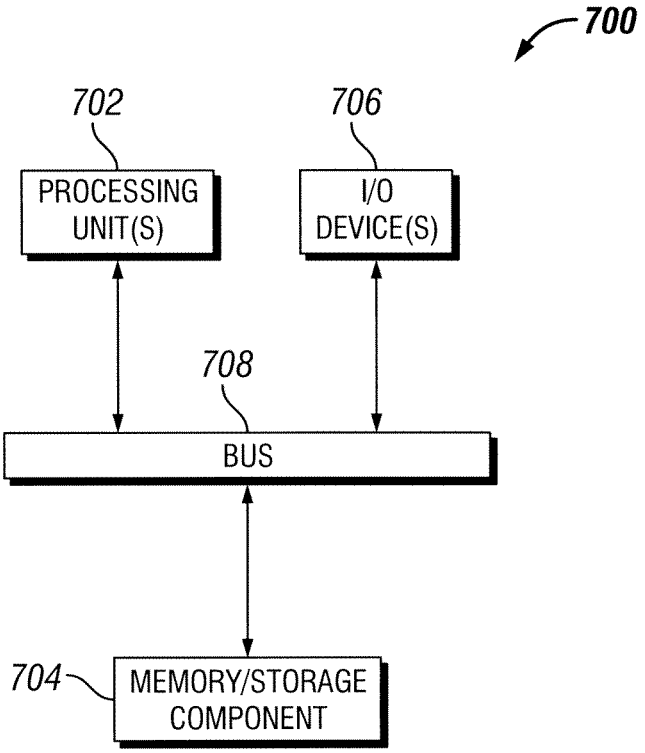
FIG. 7 shows a computer system for implementing pointing a rotary drill bit in accordance with one or more exemplary embodiments.

FIG. 7 illustrates one example of a computing device 700 used to implement one or more of the various techniques described herein, and which may be representative, in whole or in part, of the elements described herein. The computing device 700 is only one example of a computing device and is not intended to suggest any limitation as to scope of use or functionality of the computing device and/or its possible architectures. Neither should the computing device 700 be interpreted as having any dependency or requirement relating to any one or combination of components illustrated in the example computing device 700.

Referring to FIGS. 1-7, the computing device 700 includes one or more processors or processing units 702, one or more memory/storage components 704, one or more input/output (I/O) devices 706, and a bus 708 that allows the various components and devices to communicate with one another. Bus 708 represents one or more of any of several types of bus structures, including a memory bus or memory controller, a peripheral bus, an accelerated graphics port, and a processor or local bus using any of a variety of bus architectures. Bus 708 can include wired and/or wireless buses.

Memory/storage component 704 represents one or more computer storage media. Memory/storage component 704 may include volatile media (such as random access memory (RAM)) and/or nonvolatile media (such as read only memory (ROM), flash memory, optical disks, magnetic disks, and so forth). Memory/storage component 704 can include fixed media (e.g., RAM, ROM, a fixed hard drive, etc.) as well as removable media (e.g., a Flash memory drive, a removable hard drive, an optical disk, and so forth).

One or more I/O devices 706 allow a customer, utility, or other user to enter commands and information to computing device 700, and also allow information to be presented to the customer, utility, or other user and/or other components or devices. Examples of input devices include, but are not limited to, a keyboard, a cursor control device (e.g., a mouse), a microphone, and a scanner. Examples of output devices include, but are not limited to, a display device (e.g., a monitor or projector), speakers, a printer, and a network card.

Various techniques may be described herein in the general context of software or program modules. Generally, software includes routines, programs, objects, components, data structures, and so forth that perform particular tasks or implement particular abstract data types. An implementation of these modules and techniques may be stored on or transmitted across some form of computer readable media. Computer readable media may be any available non-transitory medium or non-transitory media that can be accessed by a computing device. By way of example, and not limitation, computer readable media may comprise "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

The computing device 700 may be connected to a network (not shown) (e.g., a local area network (LAN), a wide area network (WAN) such as the Internet, or any other similar type of network) via a network interface connection (not shown). Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means may take other forms, now known or later developed. Generally speaking, the computing system 700 includes at least the minimal processing, input, and/or output means necessary to practice one or more embodiments.

Further, those skilled in the art will appreciate that one or more elements of the aforementioned computing device 700 may be located at a remote location and connected to the other elements over a network. Further, one or more embodiments may be implemented on a distributed system having a plurality of nodes, where each portion of the implementation (e.g., control device 380) may be located on a different node within the distributed system. In one or more embodiments, the node corresponds to a computer system. Alternatively, the node may correspond to a processor with associated physical memory. The node may alternatively correspond to a processor with shared memory and/or resources.

The exemplary embodiments discussed herein provide for pointing a rotary drill bit in a particular direction during a field operation. Specifically, the exemplary embodiments enable and disable various portions of a rotary bit pointing device, positioned between the proximal end of a control shaft and a universal joint. In such a case, the rotary bit pointing device applies a force to the control shaft that remains substantially constant in magnitude and direction relative to the wellbore being drilled, despite the substantially constant rotation of the bottom hole assembly.

When the force is applied to the proximal end of the control shaft, the universal joint causes a substantially equal and opposing force to be applied by the distal end of the control shaft to the bit shaft. This force applied to the bit shaft points the bit in the target direction.

Although the invention is described with reference to exemplary embodiments, it should be appreciated by those skilled in the art that various modifications are well within the scope and spirit of this disclosure. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is not limited herein.

What is claimed is:

1. A rotary bit pointing device, comprising:

a shaft comprising a proximal end and a distal end;

an end plate disposed over an outer surface of the shaft toward the proximal end of the shaft, wherein the end plate comprises a top surface having a first inner perimeter, wherein the top surface comprises a plurality of passthrough apertures and a first plurality of securing apertures;

a retaining plate disposed over the outer surface of the shaft toward the distal end of the shaft, wherein the retaining plate comprises a bottom surface having a second inner perimeter, wherein the bottom surface comprises a second plurality of securing apertures;

a plurality of deflection devices disposed around the outer surface of the shaft between the end plate and the retaining plate, wherein each of the plurality of deflection devices comprises a protrusion that traverses one of the plurality of passthrough apertures;

a plurality of retaining pins disposed around the outer surface of the shaft between the plurality of deflection devices, the end plate, and the retaining plate, wherein the plurality of retaining pins are mechanically coupled to the end plate using the first plurality of securing apertures and the retaining plate using the second plurality of securing apertures; and a control device mechanically coupled to the protrusion of each of the plurality of deflection devices, wherein the plurality of deflection devices and the retaining plate are slidably coupled to a proximal end of a control shaft, wherein the control shaft comprises a middle portion mechanically coupled to a universal joint and a distal end mechanically coupled to a rotary drill bit.

2. The rotary bit pointing device of claim 1, wherein the proximal end of the control shaft is slidably disposed underneath the plurality of deflection devices.

3. The rotary bit pointing device of claim 1, wherein the control device selectively enables and disables each of the plurality of deflection devices to apply one or more forces to the proximal end of the control shaft at particular times.

4. The rotary bit pointing device of claim 3, wherein the proximal end of the shaft comprises a collar having an outer perimeter greater than the first inner perimeter of the end plate.

5. The rotary bit pointing device of claim 4, wherein the plurality of deflection devices are bladders filled with drilling fluid by the control device using the plurality of protrusions.

6. The rotary bit pointing device of claim 4, wherein the plurality of deflection devices are pistons that operate on drilling fluid fed from the control device through the plurality of protrusions.

7. The rotary bit pointing device of claim 1, wherein the proximal end of the shaft comprises a coupling feature that mechanically couples to a corresponding coupling feature of the control device.

8. A point the bit rotary steerable system, comprising:

a rotary drill bit;

a bit shaft having a distal end mechanically coupled to the rotary drill bit;

a universal joint mechanically coupled to a proximal end of the bit shaft;

a body having a distal end mechanically coupled to the universal joint;

a shaft that traverses a cavity in the rotary drill bit, the bit shaft, the universal joint, and the body, wherein the shaft is pivotally coupled to the universal joint between a proximal end and a distal end of the shaft;

a sleeve stabilizer mechanically coupled to an outer surface of the body, wherein the sleeve stabilizer extends distally toward a collar of the bit shaft; and a rotary bit pointing device that is coupled to a proximal end of the shaft and is mechanically coupled to a proximal end of the body, wherein the rotary bit pointing device comprises:

a plurality of deflection devices disposed proximately to a perimeter of the shaft, wherein each of the plurality of deflection devices comprises a protrusion; and a control device mechanically coupled to the protrusion of each of the plurality of deflection devices, wherein the control device enables at least one of the plurality of deflection devices and disables a remainder of the plurality of deflection devices so that the rotary drill bit is pointed at a particular target in a radial direction.

9. The point the bit rotary steerable system of claim 8, wherein enabling the at least one of the plurality of deflection devices applies a force in an applied direction against the proximal end of the shaft, which moves a coupling of the rotary drill bit, the bit shaft, and the distal end of the shaft in the target direction by pivoting the shaft at the universal joint.

10. A point the bit rotary steerable system, comprising:

a rotary drill bit;

a bit shaft having a distal end mechanically coupled to the rotary drill bit;

a universal joint mechanically coupled to a proximal end of the bit shaft;

a body having a distal end mechanically coupled to the universal joint;

a shaft that traverses a cavity in the rotary drill bit, the bit shaft, the universal joint, and the body, wherein the shaft is pivotally coupled to the universal joint between a proximal end and a distal end of the shaft; and a rotary bit pointing device that is coupled to a proximal end of the shaft and is mechanically coupled to a proximal end of the body, wherein the rotary bit pointing device comprises:

a plurality of deflection devices disposed proximately to a perimeter of the shaft, wherein each of the plurality of deflection devices comprises a protrusion; and a control device mechanically coupled to the protrusion of each of the plurality of deflection devices, wherein the control device enables at least one of the plurality of deflection devices and disables a remainder of the plurality of deflection devices so that the rotary drill bit is pointed at a particular target in a radial direction, and wherein the control device comprises a series of valves to control a flow of drilling fluid, wherein the drilling fluid is used to enable the plurality of deflection devices.

11. The point the bit rotary steerable system of claim 10, wherein enabling the at least one of the plurality of deflection devices applies a force in an applied direction against the proximal end of the shaft, which moves a coupling of the rotary drill bit, the bit shaft, and the distal end of the shaft in the target direction by pivoting the shaft at the universal joint.

* * * * *